United States Patent [19]

Schaal

[11] 4,139,053

[45] Feb. 13, 1979

[54] RADIATOR, ESPECIALLY FOR MOTOR VEHICLES

[75] Inventor: Hans Schaal, Stuttgart, Fed. Rep. of Germany

[73] Assignee: Daimler-Benz Aktiengesellschaft, Fed. Rep. of Germany

[21] Appl. No.: 744,298

[22] Filed: Nov. 23, 1976

[30] Foreign Application Priority Data

Nov. 27, 1975 [DE] Fed. Rep. of Germany ..... 2553254

[51] Int. Cl.[2] ..... F28F 9/10

[52] U.S. Cl. ..... 165/71; 180/68 R

[58] Field of Search ..... 165/67, 149, 71; 180/68 R; 251/144

[56] References Cited

U.S. PATENT DOCUMENTS

| | | | |
|---|---|---|---|
| 2,049,792 | 8/1936 | Acton | 165/67 X |
| 3,578,285 | 5/1971 | Carlton | 251/144 |
| 3,744,558 | 7/1973 | Childress | 165/71 |
| 3,788,419 | 1/1974 | Drane | 180/68 R |
| 3,929,201 | 12/1975 | Hoffman | 180/68 R |

*Primary Examiner*—Ronald H. Lazarus
*Assistant Examiner*—Theophil W. Streule, Jr.
*Attorney, Agent, or Firm*—Craig & Antonelli

[57] ABSTRACT

A radiator, especially for motor vehicles, which includes at the underside of its bottom at least one bearing support part for its vertical support and a drainage aperture in the bottom for the drainage of the cooling liquid; the drainage aperture thereby extends through the bearing support part.

12 Claims, 2 Drawing Figures

RADIATOR, ESPECIALLY FOR MOTOR VEHICLES

The present invention relates to a radiator, especially for motor vehicles, which is provided at the underside of its bottom with at least one bearing support for its vertical support and is provided with a drainage opening in its bottom for the drainage of cooling liquid.

With known radiators of this type (German Auslegeschrift 1,148,894), it is customary to provide the drainage opening and the bearing support for the vertical support of the radiator at different places of the radiator bottom. As a result thereof, the bottom must be equipped both at the place of the drainage opening as also at the bearing support places with special wall reinforcements and the like. Finally, the accessibility of the drainage opening is made difficult in those cases in which the radiator is arranged over a cross bearer and is supported at the latter.

The present invention is concerned with the task to eliminate the aforementioned disadvantages with a radiator of the aforementioned type.

The underlying problems are solved according to the present invention in a simple and advantageous manner in that the drainage opening extends through a bearing support part.

With the radiator according to the present invention, the bottom requires no additional reinforcement for the drainage opening. The accessibility thereof is also improved if the bearing support part fixed at the vehicle is provided with an opening aligned essentially with the drainage opening. As a result of such a construction, also the drainage of the cooling liquid is possible without difficulties in those cases in which the radiator is seated on a fixed cross bearer.

It is particularly advantageous if with the radiator according to the present invention, the bearing support part, through which extends the drainage opening, includes an extension projecting from the underside of the radiator bottom as part of a pin guidance guiding the radiator in the directions perpendicular to the bearing support axis. The extension can be formed by the guide pin itself or by the corresponding socket for the guide pin.

The arrangement may thereby be further made in such a manner according to the present invention that the bearing support part, through which extends the drainage opening, includes a bearing support seating surface for the vertical radiator support which extends essentially transversely to the bearing support axis and starts from the extension.

In the radiator according to the present invention, the manufacture thereof is facilitated in that the bearing support part, through which extends the drainage opening, and the bottom thereof are made in one piece. With a down-draft or inverted radiator, a waterbox consisting of synthetic resinous material could therefore be provided whose bottom is made in one piece with the bearing support part through which extends the drainage opening.

It is customary in radiators that the drainage opening thereof is adapted to be closed off by a drainage bolt which is detachable or disengageable at will, under interposition of an annular seal. The annular seal thereby consists frequently of copper or the like.

In the radiator according to the present invention, in contrast thereto, provision is made that the drainage opening is provided with an abutment surface cooperating with the counter-abutment surface of the drainage bolt, which limits the deformation of the annular seal during the tightening of the drainage bolt. It is possible in this manner to use relatively inexpensive rubber seals.

Accordingly, it is an object of the prevent invention to provide a radiator, especially for motor vehicles, which avoids by simple means the aforementioned shortcomings and drawbacks encountered in the prior art.

Another object of the present invention resides in a radiator, especially for motor vehicles, which obviates the need for special wall reinforcements both at the place of the drainage opening as also at the support places of the radiator.

A further object of the present invention resides in a radiator of the type described above in which the drainage opening is readily accessible for servicing.

Still a further object of the present invention resides in a radiator especially for motor vehicles in which also the manufacture is simplified while the deformation of annular seals is effectively limited.

These and other objects, features and advantages of the present invention will become more apparent from the following description when taken in connection with the accompanying drawing which shows, for purposes of illustration only, one embodiment in accordance with the present invention, and wherein.

Figure 1:
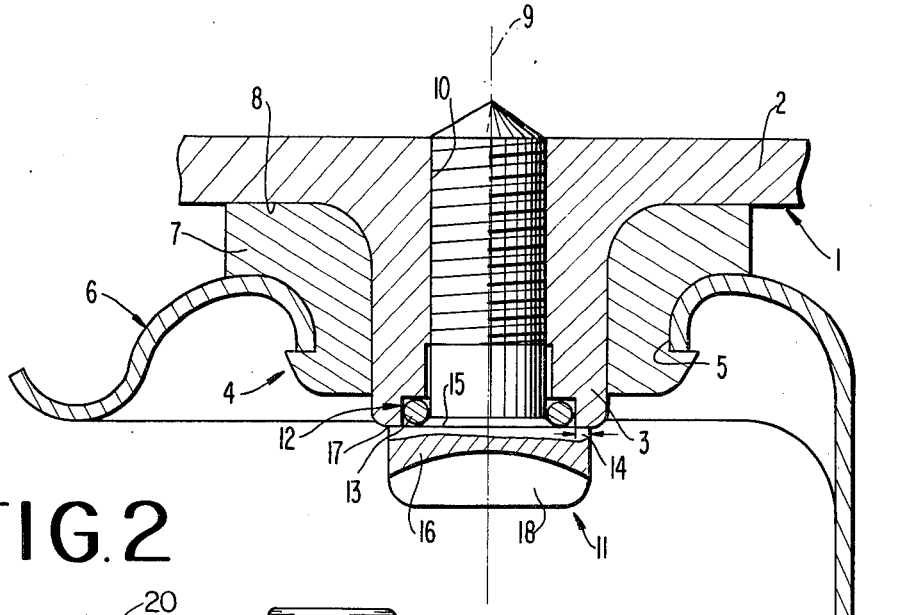
FIG. 1 is a partial vertical center cross-sectional view through a lower bearing support place of an engine radiator in accordance with the present invention which is seated on a cross bearer fixed in the vehicle.
Figure 2:
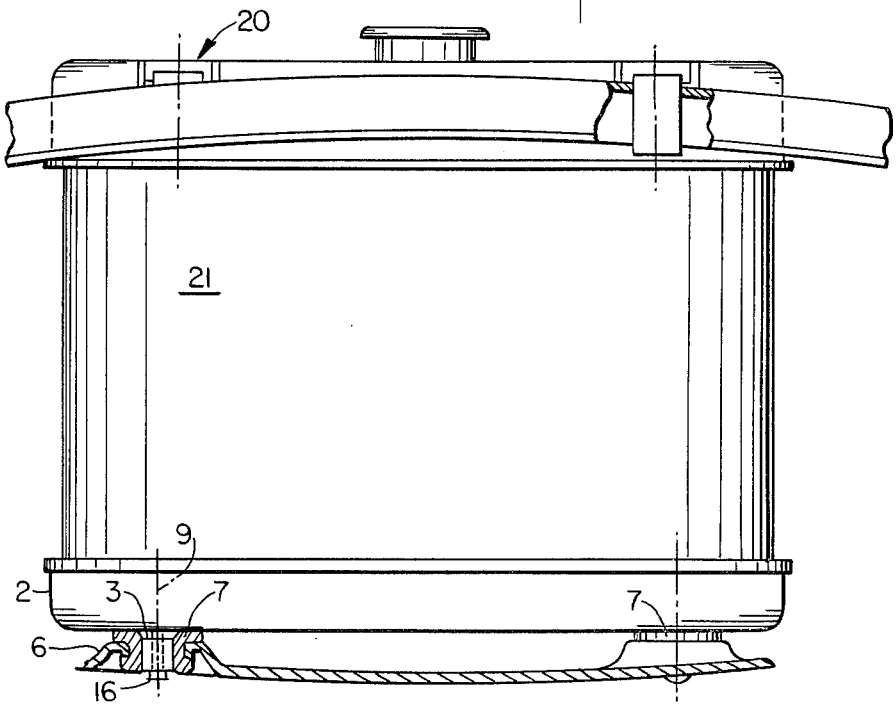
FIG. 2 is a front elevation of a radiator according to the present invention seated on a cross bearer.

Referring now to the single figure of the drawing, a guide pin 3 projects from the underside 1 of the bottom 2 of a lower waterbox (not illustrated in detail), of the engine radiator, which engages in a corresponding cylindrical mounting socket 5 of a cross bearer generally designated by reference numeral 6 and fixed at the vehicle, under interposition of an elastic ring-shaped damping pad or bumper generally designated by reference numeral 4.

An elastic collar 7 of the damping buffer 4, which is seated on the cross bearer 6, cooperates with a bearing support seating surface 8 starting from the pin base or root at the underside 1 of the bottom 2 in order to support the radiator vertically.

The guide pin 3 and the support socket 5 elastically support the lower part of the radiator in the directions perpendicular to the bearing support axis 9.

A drainage opening or aperture 10 provided with an internal thread extends through the bottom 2 and the guide pin 3 and is closed off by a drainage bolt generally designated by reference numeral 11. At its lower discharge orifice, the drainage aperture 10 is provided with a ring-shaped recess 12, into which is inserted a rubber ring seal 13.

The radially outer section 14 of the annular surface 15 of the bolt head 16 of the drainage bolt 11 is clamped directly against the lower end surface 17 of the guide pin 3 so that the rubber ring seal 13 cannot be destroyed by the tightening torque when screwing-in the drainage bolt 11.

The bolt head 16 is provided with a slot 18 for the insertion of a work tool or of a coin for the disengagement or tightening of the drainage bolt 11.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A radiator comprising a water box having a bottom wall with a bearing support projection means for providing a vertical bearing support for said water box, said support projection means extending outwardly from said bottom wall for extending through a collar means retained within a transversely extending frame member, cooling liquid drainage means, said drainage means extending through said support projection means, and a closure means for sealing said drainage means at a side of said collar means opposite from said bottom means.

2. A radiator according to claim 1, wherein said bearing support projection means is a part of a vertical radiator guidance means.

3. A radiator according to claim 2, characterized in that the bearing support projection means through which extends the drainage means, includes an extension projecting from the underside of the bottom means and guides the radiator in directions substantially perpendicular to the bearing support axis.

4. A radiator according to claim 3, characterized in that the extension is in the form of a guide pin.

5. A radiator according to claim 3, characterized in that the bearing support projection means through which extends the drainage means, includes a bearing support seating surface means for the vertical radiator support, which starts from the extension and extends essentially transversely to the bearing support axis.

6. A radiator according to claim 5, characterized in that the bearing support projection means and the bottom means are made in one piece.

7. A radiator according to claim 6, wherein said closure means is a drainage bolt and wherein an annular seal means is interposed between the bolt and said projection means, characterized in that the drainage means is provided with an abutment surface cooperating with a counter-abutment surface of the drainage bolt, which limits the deformation of the annular seal means during the tightening of the drainage bolt.

8. A radiator according to claim 1, characterized in that the bearing support projection means through which extends the drainage means, includes a bearing support seating surface means for the vertical radiator support, which starts from the extension and extends essentially transversely to the bearing support axis.

9. A radiator according to claim 1, characterized in that the bearing support part and the bottom means are made in one piece.

10. A radiator according to claim 1, wherein said closure means is a drainage bolt and wherein an annular seal means is interposed between the bolt and said projection means, characterized in that the drainage means is provided with an abutment surface cooperating with a counter-abutment surface of the drainage bolt, which limits the deformation of the annular seal means during the tightening of the drainage bolt.

11. A radiator according to claim 10, characterized in that the bearing support part and the bottom means are made in one piece.

12. A radiator according to claim 2, wherein said radiator guidance means further comprises elastic collar means.

* * * * *